US007204119B2

(12) United States Patent
Kruger et al.

(10) Patent No.: US 7,204,119 B2
(45) Date of Patent: Apr. 17, 2007

(54) HOLLOW METALLIC RING SEAL FOR PRESS

(75) Inventors: Gary A. Kruger, Troy, MI (US); John Norman Johnson, Allenton, MI (US); Richard H. Hammar, Utica, MI (US); Chongmin Kim, Bloomfield Township, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 21 days.

(21) Appl. No.: 11/149,974

(22) Filed: Jun. 10, 2005

(65) Prior Publication Data

US 2006/0277962 A1 Dec. 14, 2006

(51) Int. Cl.
*B21D 37/16* (2006.01)

(52) U.S. Cl. ..... 72/342.7; 72/60; 72/342.8; 72/350; 72/709

(58) Field of Classification Search ..... 72/54, 72/57, 60, 297, 342.1, 342.7, 342.8, 350, 72/709

See application file for complete search history.

(56) References Cited

U.S. PATENT DOCUMENTS 4,288,021 A * 9/1981 Leodolter ..... 228/15.1
5,209,093 A * 5/1993 Cadwell ..... 72/62
5,277,045 A * 1/1994 Mahoney et al. ..... 72/60
6,211,497 B1 * 4/2001 Matsen et al. ..... 219/645
6,880,377 B2 4/2005 Kim et al. ..... 72/57
6,886,383 B2 * 5/2005 Kim et al. ..... 72/57
6,910,358 B2 * 6/2005 Schroth ..... 72/57

* cited by examiner

*Primary Examiner*—Ed Tolan
(74) *Attorney, Agent, or Firm*—Kathryn A. Marra

(57) ABSTRACT

A press and tooling apparatus for forming a preheated blank includes a heated upper tool and an opposing heated lower tool mounted within the press for relative closing movement to press the preheated blank there between. A binder ring assembly surrounds the lower tool and is mounted on the press for movement relative to the lower tool so at to bind the preheated blank to the upper tool in air tight sealing relationship in readiness for closure of the tools and application of pressurized gas to force the blank into contact with the upper tools. The binder ring assembly includes an upper ring that is heated so as to prevent the cooling of the preheated blank, and a lower ring that supports the upper ring and is fixedly connected to the upper ring by spaced apart connectors so as to minimize the heat transfer path from the heated upper ring to the lower ring. The upper and lower rings have opposed seal surfaces spaced from one another to receive there between a seal of metallic hollow tubular construction which provides fluid tight sealing between the upper and lower rings, and minimizes heat transfer there between.

14 Claims, 5 Drawing Sheets

HOLLOW METALLIC RING SEAL FOR PRESS

FIELD OF THE INVENTION

The present invention relates to the press apparatus and tooling for the use of pressurized gas to stretch a preheated panel against a tool, and more particularly provides an improved gas pressure sealing arrangement.

BACKGROUND OF THE INVENTION

It is known to form sheet metal articles, such as an automotive body panel from a sheet or blank of superplastically or quick plastically formable sheet metal, which is preheated and then stretched, first against a preforming cavity tool, and then against a final forming punch tool, via the application of pressurized gas against the preheated sheet.

U.S. Pat. No. 6,880,377, assigned to the assignee of this invention, discloses a press and tooling for performing the aforedescribed process. The tooling includes a heated upper binder ring for binding the preheated sheet metal blank against the cavity tool and maintaining the temperature of the sheet metal blank for effective forming. The tooling also includes a lower binder ring that supports the upper binder ring, but is cooled in order to prevent undesired heat transfer to the press.

The present invention provides a new and improved seal for sealing the interface between the upper and the lower binder.

SUMMARY OF THE INVENTION

A press and tooling apparatus for forming a preheated blank includes a heated upper tool and an opposing heated lower tool mounted within the press for relative closing movement to press the preheated blank there between. A binder ring assembly surrounds the lower tool and is mounted on the press for movement relative to the lower tool so as to bind the preheated blank to the upper tool in air tight sealing relationship in readiness for closure of the tools and application of pressurized gas to force the blank into contact with the upper tools. The binder ring assembly includes an upper ring that is heated so as to prevent the cooling of the preheated blank, and a lower ring that supports the upper ring and is fixedly connected to the upper ring by spaced apart connectors so as to minimize the heat transfer path from the heated upper ring to the lower ring. The upper and lower rings have opposed seal surfaces spaced from one another to receive there between a seal of metallic tubular O-ring construction which provides fluid tight sealing between the upper and lower rings, and minimizes heat transfer there between.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain exemplary embodiment's embodiment(s) is merely exemplary in nature and is in no way intended to limit the invention, its application, or uses.

Description of the Press and Tooling

Figure 1:
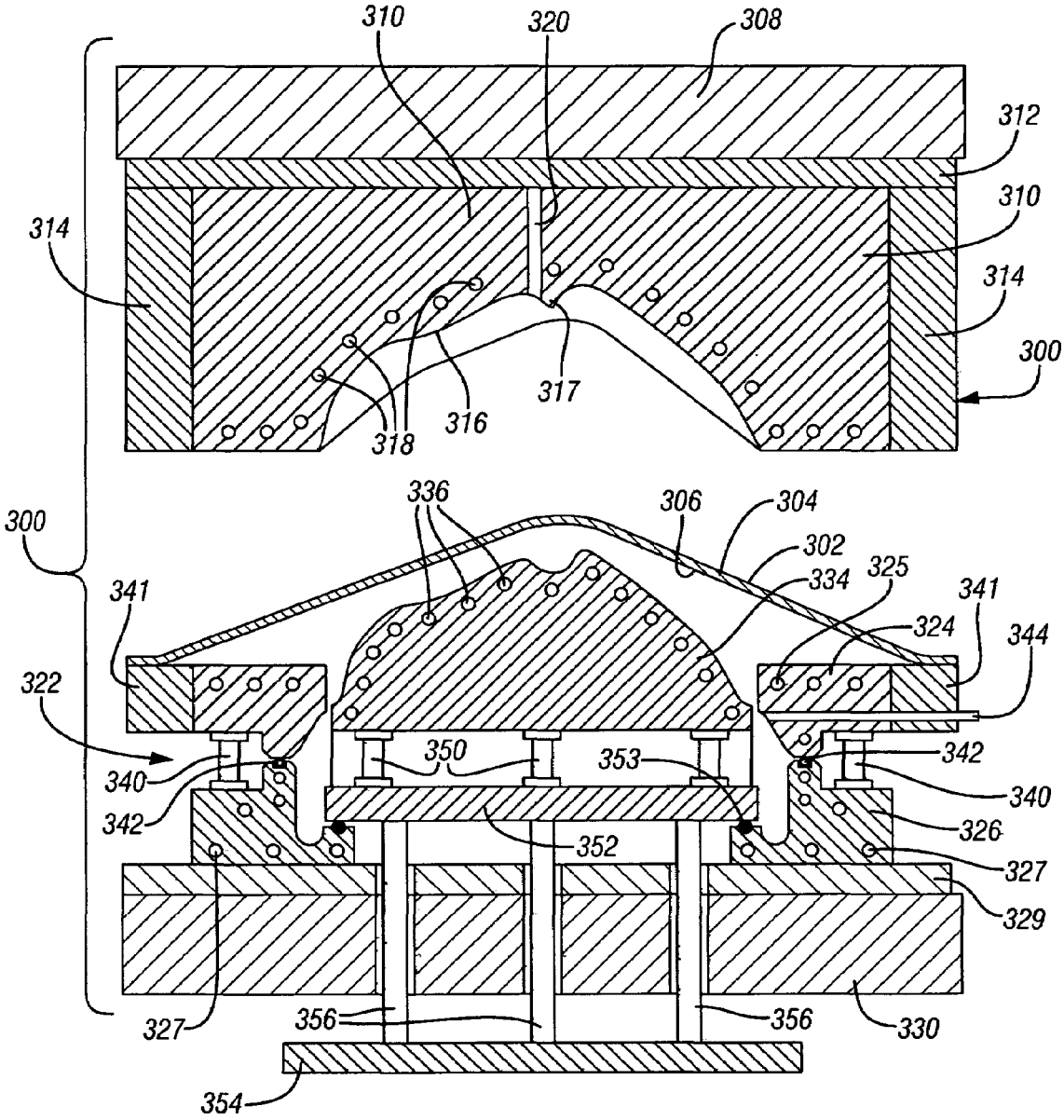
FIG. 1 is a cross sectional view showing the press and forming tools open relative one another and a preheated blank of sheet metal draped over the punch tool.

Referring first to FIG. 1, the press and tooling assembly is indicated generally at 300 and is shown in an open position for the insertion of a sheet metal blank 302. Blank 302 is shown in cross section and on edge. Sheet metal blank 302 has an upper surface 304 and a lower surface 306. The press and tooling assembly 300, includes an upper press platen 308. The full press structure and hydraulic actuating mechanisms are conventional and not shown in order to reduce the complexity of the illustrations, it being understood that a person of ordinary skill in the art will be able to adapt the present invention to many different types of presses that are available in the industry.

Securely attached to upper press platen 308 is a cavity defining upper cavity tool 310 which has a cavity 316 that is generally concave in configuration with the principal exception of a pocket preform shaping portion 317. An insulation layer 312 thermally isolates cavity tool 310 from upper platen 308, and the sides of cavity tool 310 are wrapped in insulation layers 314. Heating elements 318 are provided in the cavity tool 310 for maintaining the cavity tool 310 at a suitable temperature. Cavity tool 310 also includes a gas port 320 for admitting a working gas, under pressure, for a forming operation to be described below. Air or nitrogen is typically used as the working gas.

As seen in FIG. 1, the press lower platen 330 carries a binder ring assembly, generally indicated at 322, and including an upper ring 324 having heating elements 325, and a lower ring 326 that underlies and supports the upper ring 324 and has cooling passages 327. More particularly, it is seen that the lower ring 326 sits on a layer of load supporting insulation 329 that rests on the lower platen 330. The lower ring 326 supports the upper ring 324 via a plurality of cylindrical columns 340, and a metallic tubular O-ring seal 342 provides a gas tight seal between the upper ring 324 and the lower ring 326, as will be discussed below in greater detail in referring to FIG. 4.

As shown in FIG. 1, a lower punch tool 334 is surrounded by the binder ring assembly 322 and is movably mounted on the lower press platen 330 by a plurality of cylindrical supports 350 which are carried on a punch support plate 352.

Punch support plate 352 is in turn supported by rods 356 connected to a punch platen 354. The punch platen 354 is actuated by an actuator, not shown, to move the punch tool 334 vertically independently of the motion of press lower platen 330. As seen in FIG. 1, an elastomeric O-ring seal 353 is seated in a groove in the lower ring 326. The elastomeric O-ring seal 353 extends continuously around the inner periphery of the lower binder ring 326, to provide a gas tight seal when the punch support plate 352 is lowered onto the lower ring 326 as shown in FIG. 2.

Operation of the Press and Tooling

FIG. 1 shows the upper cavity tool 310 open relative the binder ring assembly 322 and the punch tool 334. A preheated metal blank 302 rests on a layer of insulation 341 that surrounds the upper ring 324 and is draped over the punch tool 334.

Figure 2:
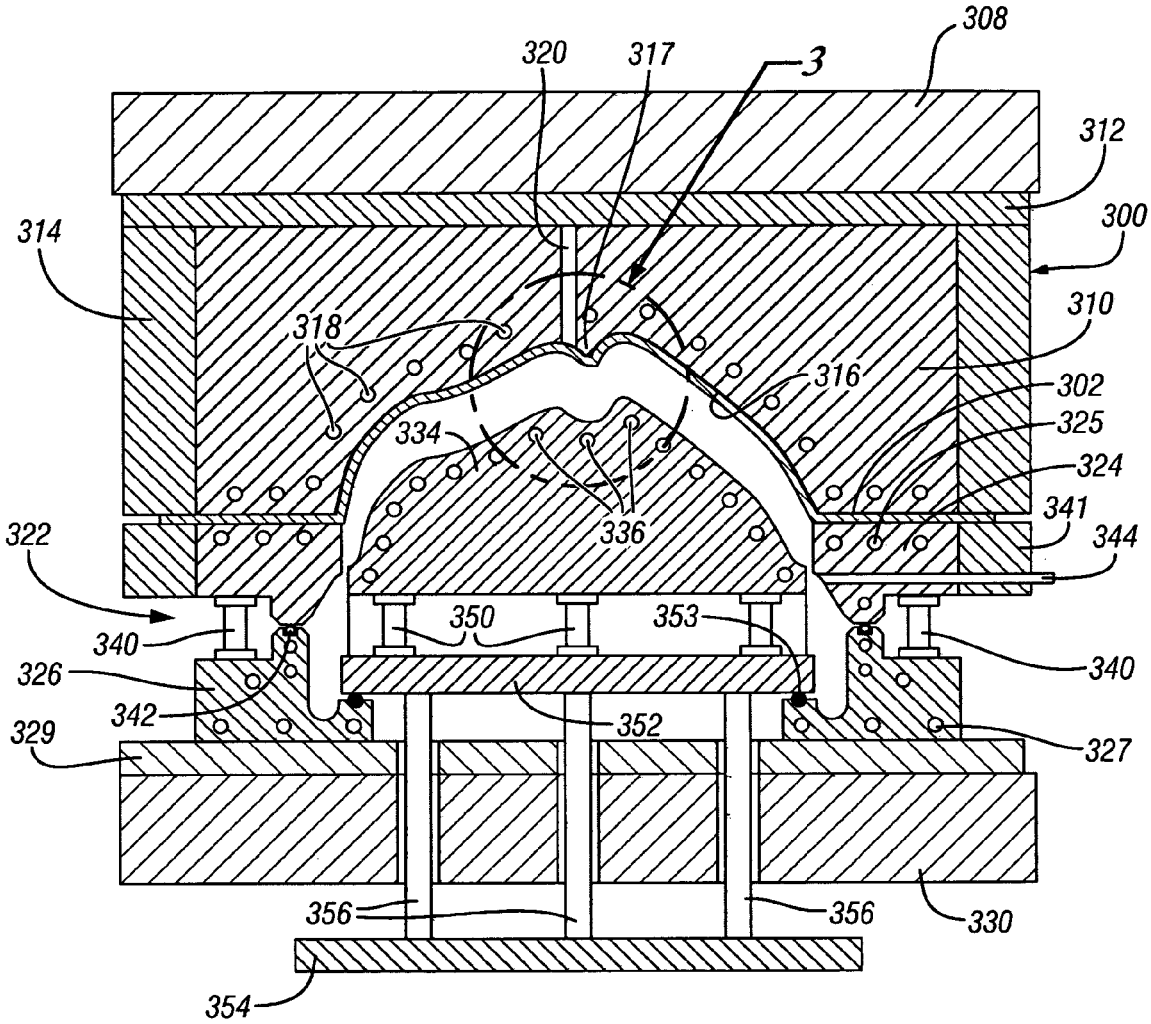
FIG. 2 shows the blank bound to the cavity tool by a binder ring assembly, and the application of a pressurized gas to preform the blank against the cavity tool.
Figure 3:
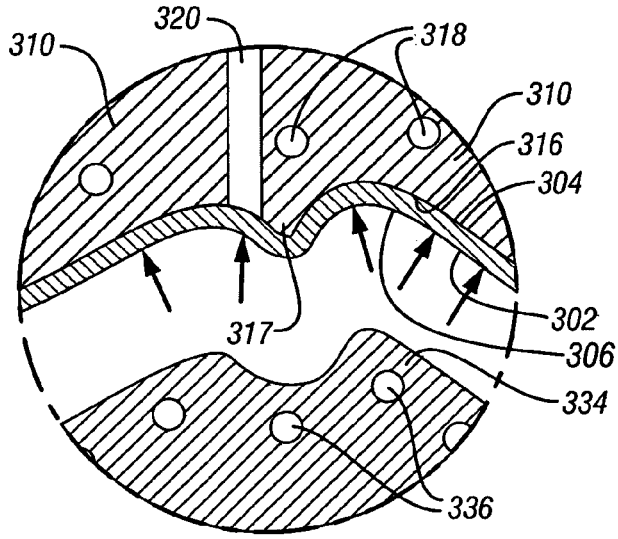
FIG. 3 shows an enlarged fragment of FIG. 2

FIG. 2 shows the upper cavity tool 310 lowered onto the binder ring assembly so that the edge of the sheet metal blank 302 is trapped between the upper ring 324 and the cavity tool 310. High pressure gas is introduced though the gas port 344 and progressively forces the sheet metal blank 302 into contact with the surface of the cavity tool 310, including the projection 317 thereof in FIG. 3. This stretching of the sheet metal blank 302 into contact with the cavity tool 310 preforms the blank 302 to a very nearly final shape. During this pressurization, the high pressure gas is prevented from leaking between the punch support plate 352 and the lower binder ring 326 by the elastomeric O-ring seal 353.

Figure 4:
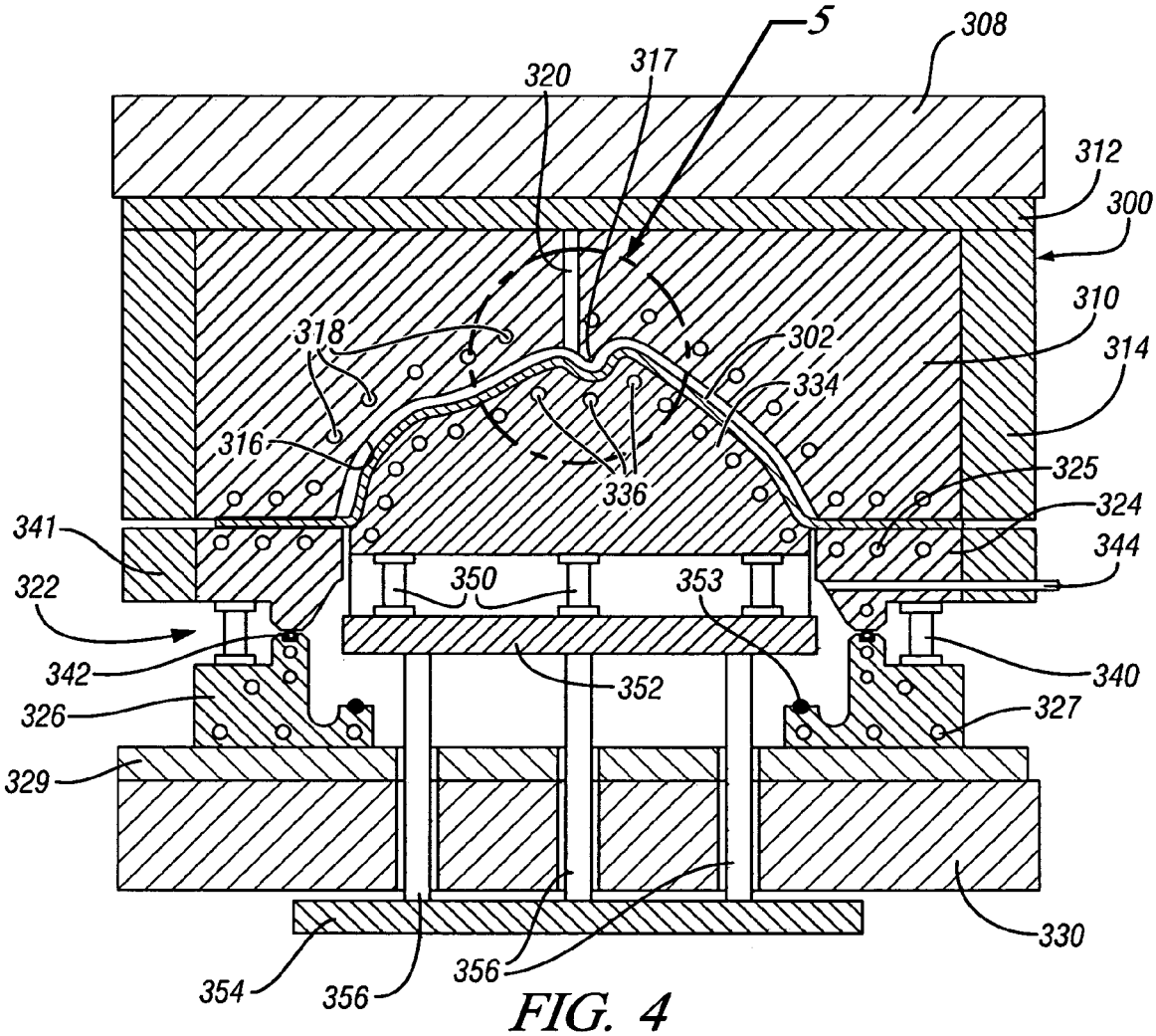
FIG. 4 shows the cavity tool and the punch tool fully closed relative one another and the application of high pressure to form the blank against the punch tool.
Figure 5:
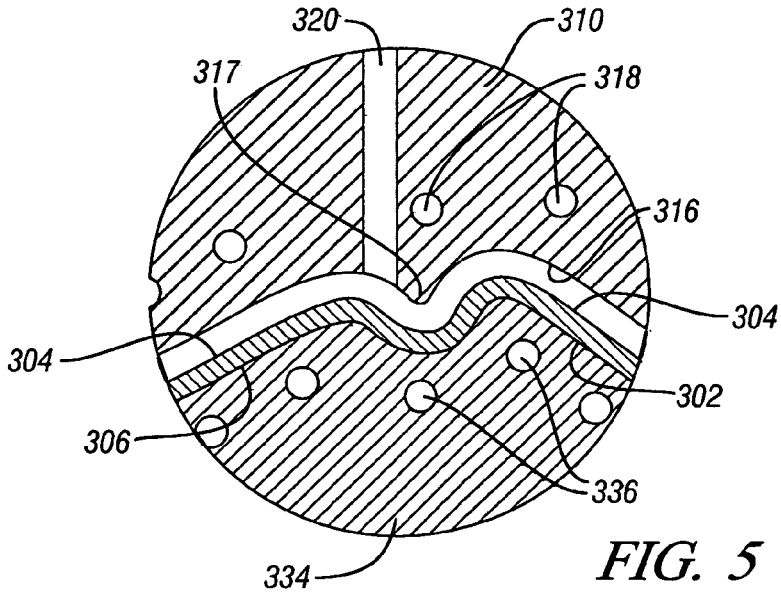
FIG. 5 shows an enlarged fragment of FIG. 4.

FIG. 4 shows the punch tool 334 elevated by the press actuator, not shown, that acts upon the lower punch platen 354. Accordingly, the surface of the punch 334 is now in closer proximity with the cavity tool 310. Air pressure is now introduced through gas duct 320 to force and stretch the sheet metal 302 away from the surface of the cavity tool 310 and into contact with the surface of punch tool 334 as shown in the enlarged view of FIG. 5. The back surface 306 of sheet metal 302 is in full contact with the surface of punch 334. The air pressure is then released through gas duct 320.

Figure 6:
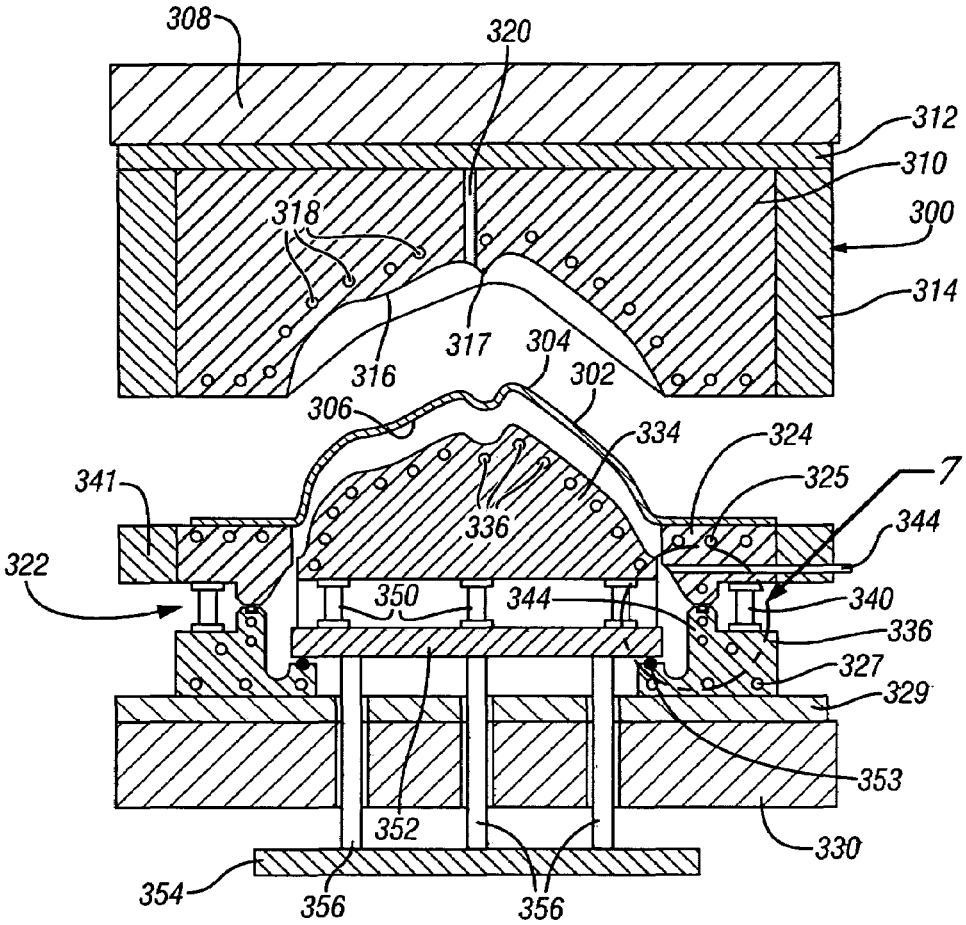
FIG. 6 shows the press and tools opened to permit removal of the fully formed article.

FIG. 6 shows the cavity tool 310 and punch tool 334 separated by activation of their respective platens 308, 330 and 354. The formed sheet metal 302, which is now in the configuration of final article, is seen resting on the binder ring 332 and ready for removal from the press and tooling assembly 300.

The Ring Assembly Seal Structure

Figure 7:
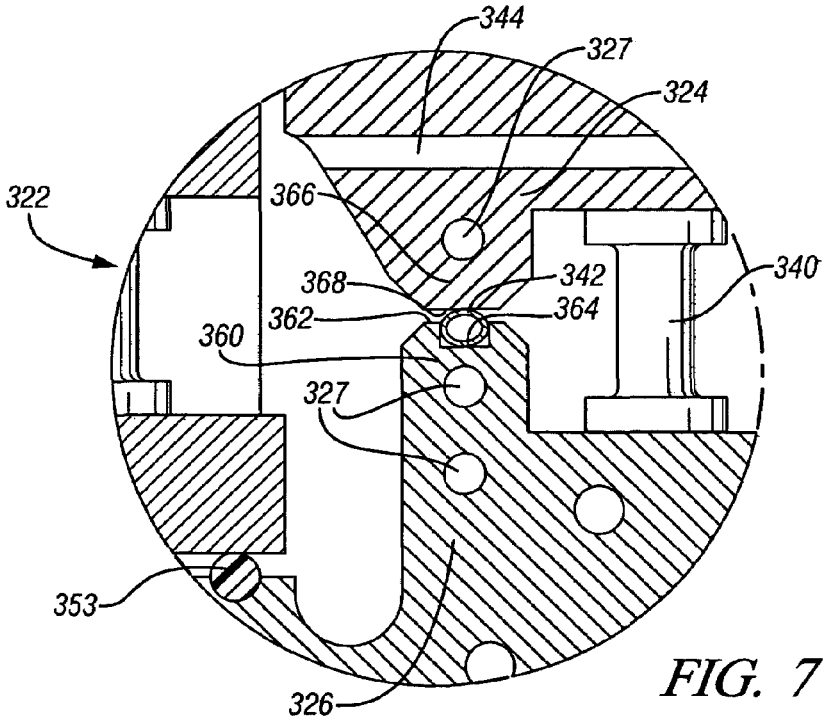
FIG. 7 is an enlarged fragmentary view showing an improved seal arrangement providing an air tight seal between an upper binder ring and a lower binder ring.

FIG. 7 is an enlarged fragmentary view showing the binder ring assembly 322, and in particularly the metallic tubular O-ring seal 342 that provides an air tight seal between the upper ring 324 and the lower ring 326. As seen in FIG. 7, the lower ring 326 has an upward extending rim portion 360 with a top surface 362, in which a groove 364 is provided. The groove 364 extends continuously all around the circumference of the lower ring 326. The upper ring 324 has a downward extending rim portion 366 with a bottom surface 368 that overlies the groove 364. The metallic tubular O-ring seal 342, in the form of a hollow tube or pipe is seated in the groove 364 and extends around the circumference of the lower ring 326. It will be appreciated that the upper ring 324 and the lower binder ring 326 are established at a fixed spaced apart relationship by the supporting columns 340. Thus the upper surface 362 of the lower ring 326 and the lower surface 368 of the upper ring 324 are established at a fixed spaced apart distance. The metallic tubular O-ring seal 342 is sized to sealingly engage with the upper surface 362 and the lower surface 368 to prevent the leakage of high pressure forming gas there between.

It will be understood and appreciated that when the press is inactive, the entire press and tooling apparatus will be at room temperature. However, during use of the press and tooling, the various parts of the press and tooling will be maintained at different operating temperatures, and those temperatures may also fluctuate somewhat during the opening, closing and operation of the press and tooling. In particular, the upper ring 324 has heating elements 325 by which the upper ring 324 may be heated to temperatures of about 850 degrees F. so as to help maintain the preheated sheet metal blank 302 at its forming temperature. At the same time however, the lower ring 326 is cooled by the cooling water passages 327 provided therein so as to protect the elastomeric O-ring seal 353 and other parts of the press from overheating. As a result, there will be appreciable temperature expansion and contraction between the upper and lower rings. The supporting columns 340 are designed to yield somewhat to accommodate the relative expanding and contracting movement between the binder rings.

The metallic tubular O-ring seal 342 has been found to effectively create a pressure tight seal between the upper and lower binder rings while at the same time accommodating the expansion and contraction between the binder rings. In particular, we have found that the hollow shape, filled with air or other gas, will transfer less heat than is the case of a solid shaped rod of similar outer diameter. It will be appreciated that the metallic O-ring seal 342 experinces a substantial temperature gradient from top to bottom, and is accordingly stressed within its elastic region so that the air tight seal is retained and yet there is not so great a stress as to cause a permanent deformation. As one example we have found that the hollow metallic O-ring seal may be made of INCONEL X750 alloy, with a tube diameter of 0.375 inches outside diameter and a wall thickness of 0.035 inches. In addition after the ring shape is fabricated from tubing, the ring is heat treated to a spring temper, so that, at normal operating temperature, the ring has been found to spring back to 0.366 inches after repeated compression to 0.3525 inches. The groove may be somewhat wider that the 0.0375 width of the metallic tubular O-ring seal 342, so that the seal is unrestrained and rests freely in the groove 364 so that the seal can slide somewhat within the groove 364 and thereby adjust itself to the various temperature induced stresses encountered during its lifetime.

Figure 8:
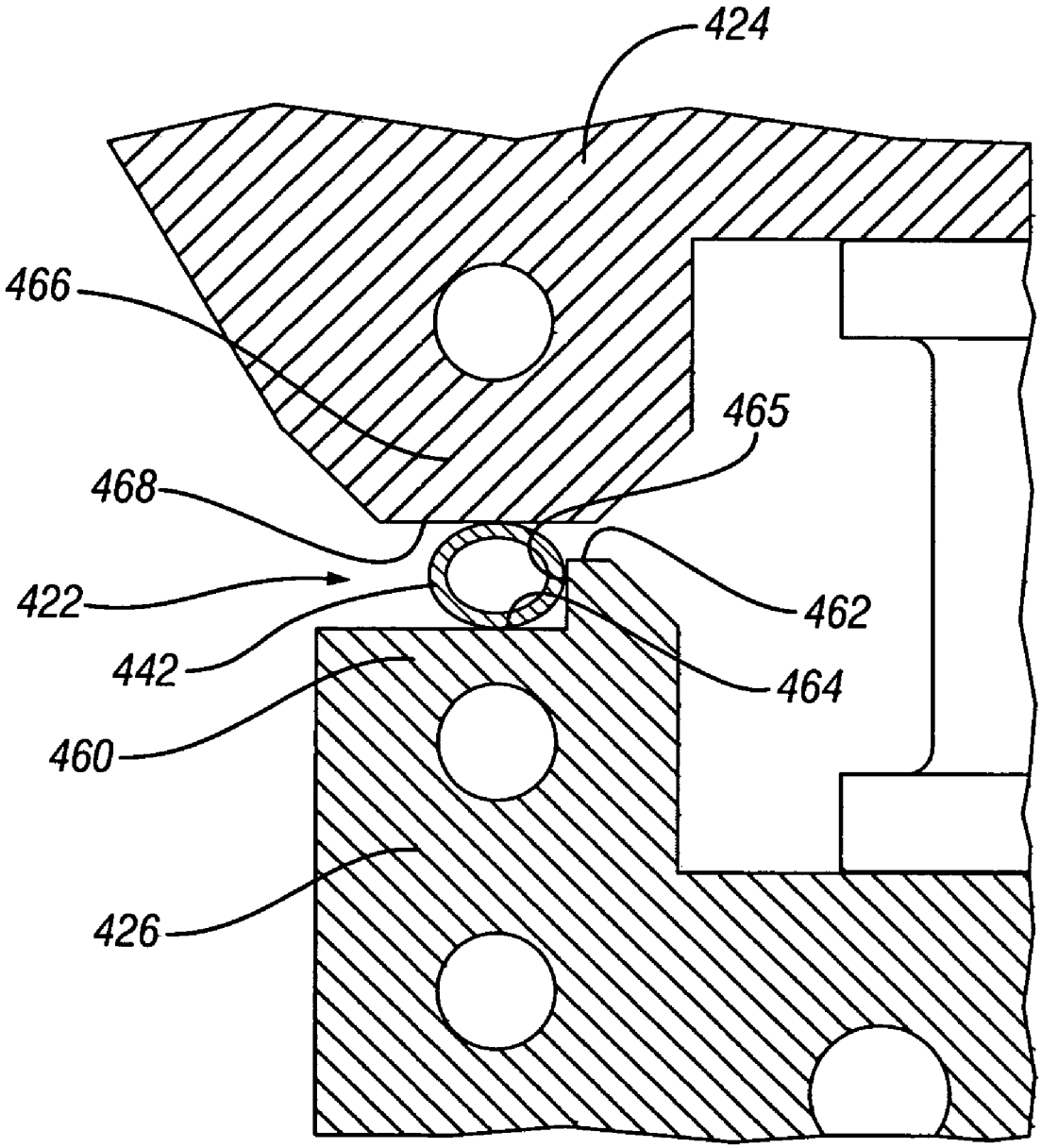
FIG. 8 is a view similar to FIG. 7 but showing an alternative sealing arrangement.

FIG. 8 shows an alternative embodiment in which ring assembly 422 includes a lower ring 426 having a rim 460 with a top surface 462. The groove 464 which seats a metallic tubular O-ring seal 442 is an open sided groove, with only a side wall 465 on the inner periphery of the rim 460 and no side wall on the outer facing side thereof. As the metallic tubular O-ring seal 442 rises in temperature from room temperature to about 850 degrees F., it will grow in circumference and in diameter and may migrate away from the side wall 465. The side wall 465 will however restrain the metallic tubular O-ring seal 442 sufficiently to maintain the seal in its sealing relationship between the upper surface 462 of the lower ring 426 and the lower surface 468 of the upper ring 424. It will be understood that the side wall 465 can be continuous, or the side wall can be discontinuous, that is, interrupted along its circumference, so long as the seal 442 is sufficiently restrained that it is held in sealing contact with the sealing surface of the upper ring and the lower ring.

The forgoing description of the invention is merely exemplary in nature and, thus, variations thereof are intended to be within the scope of the invention.

What is claimed is:

1. Press apparatus for forming a preheated blank, comprising;

a heated first tool and an opposing heated second tool mounted within the press for relative closing movement to press the preheated blank there between;

a binder ring assembly surrounding the second tool and movably mounted for movement relative to the second tool to bind the preheated blank between the binder ring assembly and the first tool in readiness for subsequent closure of the tools, the binder ring assembly including a first ring portion that is heated so as to prevent the cooling of the preheated blank, and a second ring portion that supports the first ring portion and is fixedly connected to the first ring portion by spaced apart connectors so as to minimize the heat transfer path from the heated first ring portion to the second ring portion; the first and second ring portions having opposed seal surfaces spaced from one another;

and a seal of metallic hollow tubular construction seated between the first and second ring portions to obtain fluid tight sealing between the first and second ring portions and minimize heat transfer between the first and second ring portions, said seal being of spring tempered INCONEL X750 to spring back after repeated compression.

2. The apparatus of claim 1 in which the seal surface of one of the rings is a groove that faces toward the opposing seal surface of the other ring portion and the seal is seated within the groove.

3. The apparatus of claim 2 in which the groove is provided in the seal surface of the lower ring.

4. The apparatus of claim 2 in which the groove is an open sided groove having a wall only on the inboard side of the seal so that the wall restrains the seal within the space between the ring portions but allows the seal to expand and contract in response to temperature changes.

5. The apparatus of claim 1 in which the seal is a tube of an outside diameter of about 0.375 inches and a wall thickness of about 0.035 inches.

6. The apparatus of claim 5 in which the seal is spring tempered by heat treatment to obtain spring back to 0.366 inches after repeated compression to 0.3525 inches.

7. The apparatus of claim 2 in which the groove in the seal surface of the second ring seats the seal for sliding movement within the groove.

8. Press apparatus for forming a preheated blank, comprising;

a heated upper tool and an opposed heated lower tool mounted within the press for relative closing movement to press the preheated blank there between;

a binder ring assembly surrounding the lower tool and movably mounted for movement relative to the lower tool to bind the preheated blank between the binder ring assembly and the upper tool in readiness for subsequent closure of the tools and application of gas pressure to press the blank against the upper tool;

the binder ring assembly including an upper ring that is heated so as to prevent the cooling of the preheated blank, and a lower ring that supports the upper ring; the upper and lower rings having opposed seal surfaces spaced from one another;

a groove provided in the seal surface lower ring and extending continuously around the periphery of the lower ring;

and a seal seated in the groove of the lower ring and extending circumferentially around the ring assembly and extending into sealing contact with the seal surface of the upper ring, the seal being formed of a hollow tube of INCONEL X750 metal that is spring tempered and with gas filling the hollow of the tube to slow the transfer of heat through the seal from the heated upper ring to the lower ring and to seal tightly with the upper and lower rings to prevent the leakage of gas pressure between the upper and lower rings when the gas pressure is applied to press the blank against the upper tool.

9. The apparatus of claim 8 in which the groove is an open sided groove having a wall only on the inboard side of the seal so that the wall restrains the seal within the space between the ring portions but allows the seal to expand and contract in response to temperature changes.

10. The apparatus of claim 8 in which the seal is a tube of an outside diameter of about 0.375 inches and a wall thickness of about 0.035 inches.

11. The apparatus of claim 10 in which the seal is spring tempered by heat treatment to obtain spring back to 0.366 inches after repeated compression to 0.3525 inches.

12. A press apparatus for forming a preheated blank, comprising;

a heated upper tool and an opposed heated lower tool mounted within the press for relative closing movement to press the preheated blank there between;

a binder ring assembly surrounding the lower tool and movably mounted for movement relative to the lower tool to bind the preheated blank between the binder ring assembly and the upper tool in readiness for subsequent closure of the tools and application of gas pressure to press the blank against the upper tool;

the binder ring assembly including an upper ring that is heated so as to prevent the cooling of the preheated blank, and a lower ring that supports the upper ring; the upper and lower rings having opposed seal surfaces spaced from one another;

a groove provided in the seal surface of the lower ring and extending continuously around the periphery of the lower ring, the groove having a side wall on one side to restrain the seal, and a seal seated in the groove of the lower ring and extending circumferentially around the ring assembly and extending into sealing contact with the seal surface of the upper ring, the seal being formed of a hollow tube of INCONEL X750 metal that is spring tempered and with gas filling the hollow of the tube to slow the transfer of heat through the seal from the heated upper ring to the lower ring and to seal tightly with the upper and lower rings to prevent the leakage of gas pressure between the upper and lower rings when the gas pressure is applied to press the blank against the upper tool.

13. The apparatus of claim 12 in which the groove is an open sided groove having a wall only on the inboard side of the seal so that the wall restrains the seal within the space between the ring portions but allows the seal to expand and contract in response to temperature changes.

14. The apparatus of claim 12 in which the seal is a tube of an outside diameter of about 0.375 inches and a wall thickness of about 0.035 inches, and the seal is spring tempered by heat treatment to obtain spring back to 0.366 inches after repeated compression to 0.3525 inches.

* * * * *